US007774991B2

(12) United States Patent
Fletcher et al.

(10) Patent No.: US 7,774,991 B2
(45) Date of Patent: Aug. 17, 2010

(54) PORTABLE GROUND FLOORING SYSTEMS AND METHODS OF ASSEMBLING AND PACKING SAME

(75) Inventors: G. Shane Fletcher, Winchester, VA (US); Edward Bindon, Fairfax, VA (US)

(73) Assignee: Ground Floor Systems, LLC, Winchester, VA (US)

( * ) Notice: Subject to any disclaimer, the term of this patent is extended or adjusted under 35 U.S.C. 154(b) by 149 days.

(21) Appl. No.: 11/906,421

(22) Filed: Oct. 2, 2007

(65) Prior Publication Data

US 2008/0083182 A1 Apr. 10, 2008

Related U.S. Application Data

(60) Provisional application No. 60/849,231, filed on Oct. 4, 2006.

(51) Int. Cl.
*E04F 15/00* (2006.01)

(52) U.S. Cl. ..... 52/71; 52/177; 52/586.2; 52/69; 404/47; 404/36; 428/60

(58) Field of Classification Search ..... 52/586.1, 52/586.2, 582.1, 177, 588.1, 71, 69, 70, 698; 404/36, 40, 41, 47, 48, 49; 403/252, 253, 403/254, 255, 292, 293, 294, 295; 428/58, 428/60

See application file for complete search history.

(56) References Cited

U.S. PATENT DOCUMENTS

| | | | | | |
|---|---|---|---|---|---|
| 3,284,819 | A | * | 11/1966 | Nissen | 5/420 |
| 3,348,459 | A | * | 10/1967 | Harvey | 404/35 |
| 3,377,931 | A | | 4/1968 | Hilton | |
| 3,460,860 | A | * | 8/1969 | Stevens, Jr. | 52/584.1 |
| 3,742,911 | A | * | 7/1973 | Lehe et al. | 119/529 |
| 4,381,324 | A | * | 4/1983 | Ellingson, Jr. | 428/58 |
| 4,438,605 | A | * | 3/1984 | DeLucia | 52/71 |
| 4,488,833 | A | * | 12/1984 | Perry et al. | 404/35 |
| 4,568,587 | A | * | 2/1986 | Balzer | 428/52 |
| 4,654,245 | A | * | 3/1987 | Balzer et al. | 428/52 |
| 4,663,903 | A | | 5/1987 | Ellingson, Jr. | |
| 4,730,428 | A | * | 3/1988 | Head et al. | 52/309.11 |
| 4,747,441 | A | * | 5/1988 | Apolzer et al. | 160/206 |

(Continued)

FOREIGN PATENT DOCUMENTS

| | | |
|---|---|---|
| WO | WO 86/05224 A1 | 9/1986 |

OTHER PUBLICATIONS

International Search Report and Written Opinion for PCT/US07/21319 issued Apr. 30, 2008.

*Primary Examiner*—Robert J Canfield
*Assistant Examiner*—Babajide Demuren
(74) *Attorney, Agent, or Firm*—Williams Mullen, PC; Thomas F. Bergert

(57) ABSTRACT

A portable flooring system has one or more hinge members which can be used to quickly connect and secure panels or slats of the flooring system for deployment, while also allowing fast disassembly and stacking for storage or transport. The hinge member(s) can comprise a living hinge element interfacing with a pair of female elements or a female element and a male element of adjoining flooring slats. In one embodiment, the hinge elements are welded or otherwise permanently affixed to the flooring panels.

13 Claims, 3 Drawing Sheets

U.S. PATENT DOCUMENTS 4,777,777 A * 10/1988 Massimo ..... 52/586.2
4,877,672 A 10/1989 Shreiner
5,050,362 A 9/1991 Tal et al.
5,066,001 A * 11/1991 Wilkinson ..... 482/52
5,088,434 A * 2/1992 Harding ..... 114/85
5,157,804 A * 10/1992 Williams ..... 15/161
5,486,392 A * 1/1996 Green ..... 428/54
5,502,930 A * 4/1996 Burkette et al. ..... 52/71
5,513,472 A * 5/1996 Olsen et al. ..... 52/177
5,527,128 A 6/1996 Rope et al.
5,833,386 A 11/1998 Rosan et al.
7,090,430 B1 8/2006 Fletcher et al.
7,108,902 B2 * 9/2006 Ellingson ..... 428/54

* cited by examiner

Fig. 2
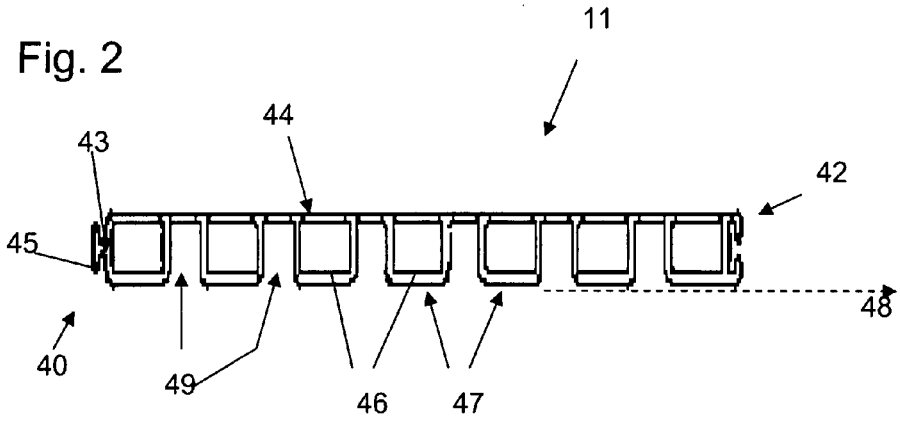
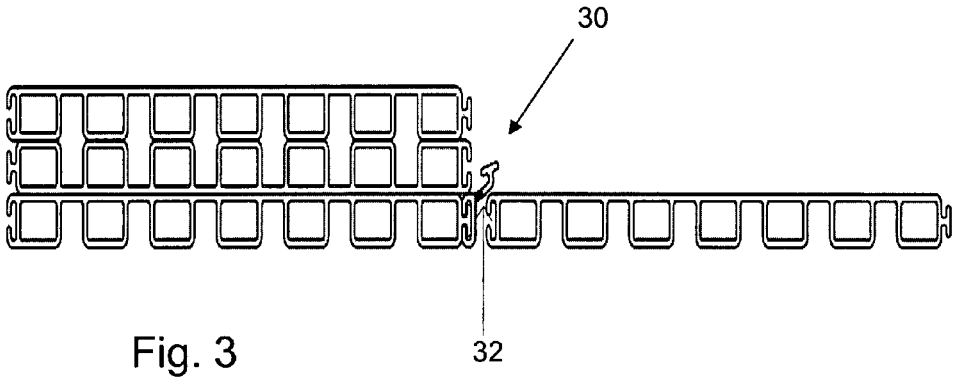
Fig. 3
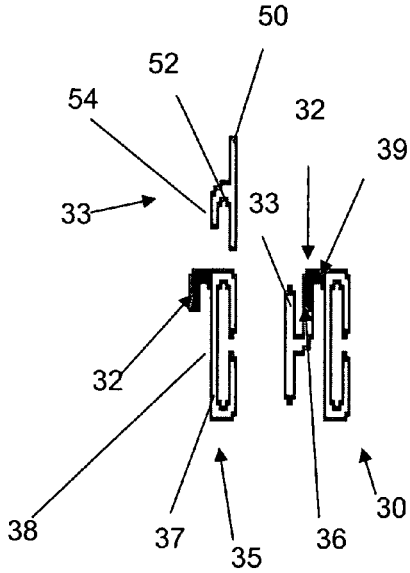
Fig. 4

Fig. 5
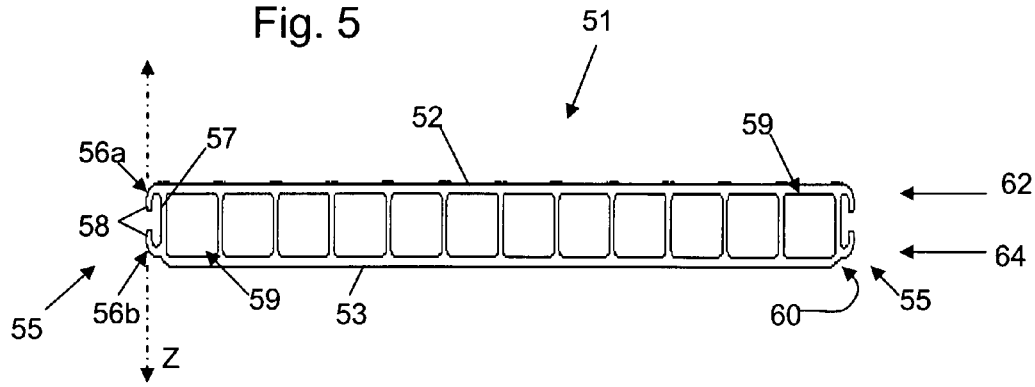
Fig. 7A
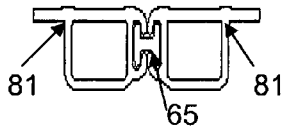
Fig. 7B
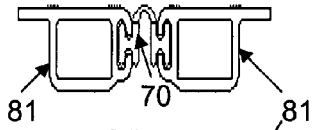
Fig. 7C
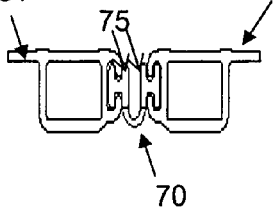
Fig. 6A
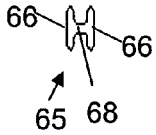
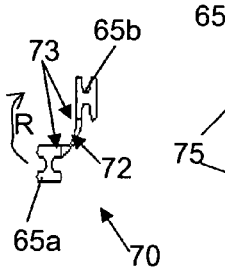
Fig. 6B
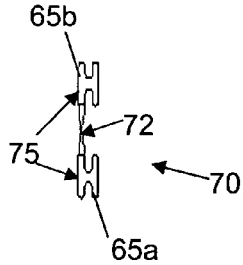
Fig. 6C
Fig. 8A
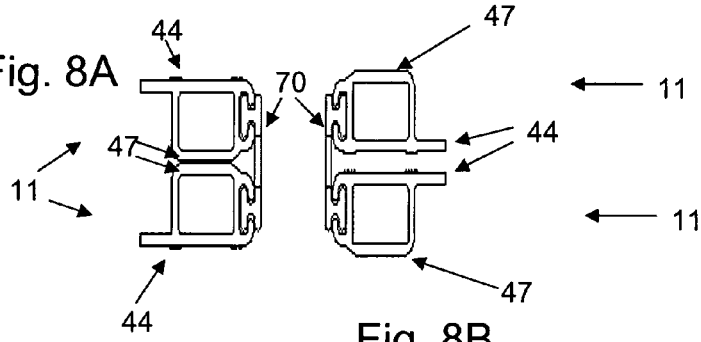
Fig. 8B

PORTABLE GROUND FLOORING SYSTEMS AND METHODS OF ASSEMBLING AND PACKING SAME

REFERENCE TO RELATED APPLICATIONS

This application claims the benefit of U.S. provisional patent application Ser. No. 60/849,231, filed Oct. 4, 2006 and entitled "Portable Ground Flooring Systems and Methods of Assembling and Packing Same", the disclosure of which is incorporated herein by reference.

FIELD OF THE INVENTION

The present invention relates to portable ground flooring systems, and more particularly to portable ground flooring systems having specially adapted hinge members to assist in storage and transport, as well as methods of installing and using the same.

BACKGROUND

Unmodified ground surfaces hinder the ability to set up quick, stable, level and secure environments for a variety of purposes. For example, outdoor field events such as carnivals, corporate outings, wine tastings, mountain bike races and even military deployments often require booths, tents or other structures with solid and stable flooring from which to manage the event. Particularly if computers or other equipment typically found in an indoor workplace environment are required, it becomes almost essential to provide a more stable, strong, level and secure ground flooring capable of rapid deployment and disassembly. Wet environments such as might be found in the above illustrative cases or in/around hospital settings, for example, also present particular challenges in providing a secure, stable surface which keeps water and other liquids from collecting and interfering with people and equipment moving atop the surface.

Recently, flooring systems and methods have been developed that minimize necessary storage space when not in use or when being transported and minimize pack-up time and effort, while also maintaining sufficient overall strength. Such flooring systems can be adapted to various shapes of ground surfaces and wet environments, including uneven ground. Such flooring systems are described, for example, in our jointly owned and co-pending U.S. patent application Ser. Nos. 11/253,980, 11/495,791 and granted U.S. Pat. No. 7,090,430, which are incorporated by reference herein in their entireties.

SUMMARY OF THE PRESENT INVENTION

The present invention provides a portable flooring system having one or more hinge members which can be used to quickly connect and secure panels or slats of the flooring system for deployment, while also allowing fast disassembly and stacking for storage or transport. By way of example, such flooring systems can be used as flooring for military applications, entertainment and sporting event applications, racing pit and staging area protection applications, landscaping and construction access protection and various other flooring uses. The present invention unfolds for fast set up, and folds up for fast take down as well as for compact storage and transport. In one embodiment, the slats or panels can be formed of high-impact plastic which largely conforms to non-level, rolling ground while maintaining bridging strength for ground discontinuities.

The slats can be secured in a series, and a series of slats can be secured in multiple rows to create a solid, manipulable floor readily deployable on ground areas of virtually any shape and wetness characteristics.

The hinge member(s) of the present invention can be used to secure the multiple slats or panels edge-to-edge while also allowing quick fold up of panels in a face-to-face format as described in more detail herein. In one embodiment, each hinge member is made of thermo-formed and co-extruded plastic material or other solid material suitable for the purposes of the present invention.

BRIEF DESCRIPTION OF THE DRAWINGS

FIG. 2 is a front elevation of one embodiment of a panel member for use with the present invention.

FIG. 3 is a front elevation of adjacent panel members which can be folded, stored and transported in accordance with the present invention.

FIG. 4 shows front elevation views of several hinge members in accordance with the present invention.

FIG. 5 is a front elevation of a separate embodiment of a panel member for use with the present invention.

FIGS. 6A through 6C show front elevation views of separate hinge member embodiments in accordance with the present invention.

FIGS. 7A through 7C show front elevation views of portions of adjacent panel members lying flat in a substantially coplanar fashion, connected by different hinge member embodiments or positions.

FIGS. 8A and 8B show front elevation views of portions of adjacent panel members in the folded up position in accordance with one aspect of the present invention.

MODE(S) FOR CARRYING OUR THE INVENTION

Figure 1:
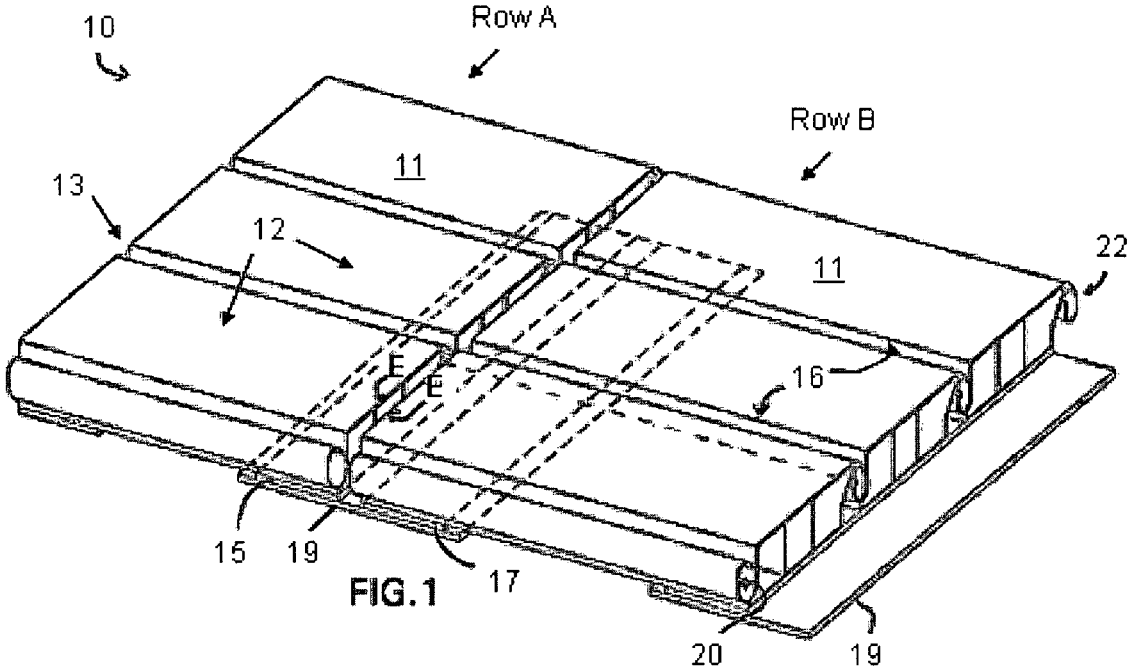
FIG. 1 is a perspective view of a flooring having panels which can be connected on their edges and which can be connected in series for expansion.

FIG. 1 shows a perspective view of a roll-up flooring not employing the hinge member(s) of the present invention. As shown therein, a flooring 10 can be constructed by aligning multiple panel or slat members 11 edge (E) to edge (E) in parallel rows (e.g., Rows A and B). The panels can comprise unitary members of ABS plastic or similar material, with top surfaces 12, bottom surfaces 14 and side walls 16. The side walls 16 extend substantially the length of the slat. While FIG. 1 shows a rectangular shape, it will be apparent from the disclosure herein that the present invention can be adapted to suit other shapes as desired, including without limitation, circular, polygonal or other shape. Individual connector members 20, 22 secure panel members horizontally, two at a time. In one embodiment, the connector members bring adjacent panels into a tight adjacent fit to give the semblance of a permanent seam 13, which thereby prevents "punch through" of loads which may be borne directly on a given seam.

The panel members can be secured together as rows through the use of "hook" and "loop" type fasteners as well as VHB "very high bond" fastening systems as are generally known in the art. As shown in FIG. 1, for example, loop strips 15, 17 can be secured to the bottom or top side of rows of panels using VHB material. The VHB material adheres to the bottom of the panels, such that approximately one-half of the width of the loop strip 15 is secured to the bottom of one row of panels (e.g., Row A) and the approximate other half of the width of the loop strip 17 is secured to the bottom of the longitudinally adjacent row of panels (e.g., Row B). In one embodiment of the invention, strips 15 and 17 are 1.5 inches in width. With the strip securely in place, the outwardly facing loop sections are available for mating with a larger "hook" strip 19. As shown in the example in FIG. 1, a hook strip can be wide enough (e.g., 4 inches in width) to secure to two loop strips on adjoining panel rows. In this way, the rows of panel members can be tightly secured.

While the configuration in FIG. 1 can facilitate rolling up the flooring for storage and transport, there are many cases where having the flooring in a rolled-up condition is undesirable, such as, for example, when the profile of the rolled-up flooring is too large to fit within a particular storage or transport environment. In such cases, the system of the present invention assists in providing an alternative means of rapid set up, breakdown and transport.

As shown in FIGS. 2 through 8B, the hinge members 30 and 70 of the present invention can connect adjacent slats so as to assist in the efficient fold up of slats for ease of transport and storage. As shown in the FIG. 2 embodiment of the present invention, for example, each slat or panel member 11 can be provided with hinge engaging edge members in the form of a male end 40 and a female end 42. Each slat can further be provided with a substantially planar top surface 44 and one or more flat bottomed segments 46 aligned such that the bottom surfaces 47 lie in a plane 48 substantially parallel to top surface 44. The form and positioning of segments 46 creates gaps 49 which can reduce the weight of the flooring and can further assist in proper liquid or fluid management when the flooring of the present invention is used in wet environments. Segments 46 can be solid or hollow, as shown in FIG. 2. Male end 40 can be substantially T-shaped as shown in FIG. 2 or can be "doll's head" shaped as will be understood in the art. Male end includes a neck portion 43 and a head portion 45 that extends from the neck portion in at least two directions. Female end 42 is adapted to receive male end 40 regardless of the form of male end.

In one embodiment of the present invention, the panels are approximately ½ to two inches in height and five to seven feet in length, but other sizes can be produced depending upon the particular implementation involved. The invention is not dimensionally constrained.

In an alternative embodiment of the present invention as shown in FIG. 5, for example, each slat or panel member 51 can include substantially planar top 52 and bottom 53 wall members without any gaps as shown in panel member 11 of FIG. 2. Further, the panel member 51 can be provided with hinge engaging edge members in the form of two female ends 55, instead of a male and female end as in member 11 of FIG. 2. In one embodiment of the present invention, female end is substantially "C" shaped with top 56*a* and bottom 56*b* hook-shaped portions having outward face portions 58 that are substantially coplanar (as shown with dashed line Z) and a central, substantially straight connector portion 57. In one embodiment of the present invention, connector portion 57 is integrally formed with and forms part of the wall of the outer segments 59 of the panel member 51, and is substantially parallel to the outward face portions 58 of the female ends. In another embodiment of the present invention, as shown in FIG. 5, the top hook-shaped portion 56*a* extends substantially directly outwardly from, and substantially coplanar with, the planar top wall member 52, while the bottom hook-shaped portion 56*b* extends from a curved bottom edge 60 of the bottom planar wall member 53, and thus does not have a portion that is coplanar with the bottom wall member. Thus, in this embodiment, the top portion 62 of the slat member and/or edge member is not a mirror image of the bottom portion 64 of the slat member and/or edge member. This can be helpful in properly aligning top sides versus bottom sides during installation of the present invention. Further, this can be helpful in facilitating proper fold up of the present invention using the hinge members as described herein. In a separate embodiment, the present invention can include a slat member having top 62 and bottom 64 portions that are mirror images of one another, wherein no curved bottom edge 60 is provided and the bottom hook-shaped portion 56*b* extends substantially directly outwardly from, and substantially coplanar with, the bottom planar member. Such an embodiment is shown in connection with female edge member 42 in FIG. 2.

As shown in FIGS. 3 and 4, attachment means for attaching two slats together is provided in the form of hinge member 30. Hinge member 30 includes a living hinge element 32 which connects male and female ends of the slat members. Hinge member 30 includes a male connector portion 33 and female connector portion 35 developed and extruded to mate with female and male ends, respectively, of the panels. Living hinge element 32 is provided as a flexible yet stable connector member which permits relative rotation of one panel member in relation to another panel member. As shown in FIG. 4, male connector portion 33 can initially be provided with an insert head 50, a neck 52 and a single shoulder 54 which is attached to the male end tip 36 of living hinge element 32. As further shown in FIG. 4, female connector portion 35 is provided with an enclosure 37 for receiving male ends 40 of panel members, wherein the enclosure has a substantially flat back face 38, to which the female end tip 39 of living hinge element 32 is secured.

In an alternative embodiment of the invention, male end 40 of each panel member can comprise living hinge element 32 and male connector portion 33, such that separate hinge members 30 are not required. In this fully integrated embodiment, no additional female connector portion of hinge member is required, as the male end 40 as adapted to include living hinge element would simply engage the female end 42 of the next respective panel member.

Through use of the hinge member 30 of the present invention, it will be seen as in FIG. 3 that successive panel members can be easily joined side-to-side for ease of stacking and transport. When one panel is rotated for stacking, living hinge element 32 flexes such that the panel can be rotated without losing connection to the adjacent panel, thereby allowing panels to be stacked such that top surfaces 44 of adjacent panels are mated and bottom surfaces 47 of other adjacent panels are mated.

While female end tip 39 of hinge member 30 is shown secured to the top of the back face 38 of enclosure 37, it will be appreciated that female end tip 39 can be secured to the middle or other portion of the back face 38.

FIGS. 6A through 6C show an H-shaped connector member 65 and hinge member 70 for use in connecting two slat members, such as those having the slat member embodiment 51 of FIG. 5. As shown in FIG. 6A, hinge member element (connector member) 65 includes two side wall members 66 joined by a middle connector member 68 so as to provide a substantially H-shaped member without the use of a living hinge element. Connector member 65 can be employed in a direct connection of slat members 81 as shown in FIG. 7A. The side wall members 66 are substantially parallel and the middle connector member 68 connects the midsections thereof at a substantially right angle as shown. In FIGS. 6B and 6C, two hinge member elements 65*a* and 65*b* are employed as part of hinge member 70. The connector members 65*a-b* are connected by a living hinge element 72 having desired flexibility to permit a substantially full range of motion as between connector members 65*a-b*, on the order of at least 180 degrees from a starting rested position. In other words, FIG. 6C shows members 65*a* and 65*b* in the rested position, with top faces 75 lying substantially in the same plane. As member 65*a* is rotated in relation to member 65*b* (see direction R in FIG. 6B) as permitted by living hinge element 72, the first connector member 65*a* can ultimately rotate up to at least 180 degrees, so that top faces 75 are positioned facing one another (such as shown in FIG. 7B, for example). Because living hinge member 72 is flexible in both directions and will maintain its strength and durability over a long period of time and with continued use, it will be appreciated that the connector members 65*a* and 65*b* can be rotated in the opposite direction from that shown in FIG. 6B; however, because the living hinge element 72 is connected to the respective side wall members 66 (having the top faces 75) of the connector members 65*a* and 65*b*, the rotation in the direction opposite that to direction R shown in FIG. 6B will not be as extensive (i.e., 180 degree rotation in this opposite direction will not be permitted). This is acceptable because rotation in the direction opposite that shown by the arrow R in FIG. 6B is not desirable.

The living hinge member 72 has two male end tips that connect, respectively to the connector members 65*a* and 65*b*. As shown in FIGS. 6B and 6C, the male end tips of living hinge member 72 connect to the vertical edge 73 of one side wall 66 of each connector member 65*a-b*.

FIG. 8A shows how the hinge member 70 of FIGS. 6B and 6C can be employed to stack two or more panel members 11 such that surfaces 44 are on the outside and surfaces 47 are on the inside. FIG. 8B shows how the hinge member 70 of FIGS. 6B and 6C can be employed to stack two or more panel members 11 such that surfaces 44 are on the inside and surfaces 47 are on the outside. It will be appreciated that the living hinge element 75 is in the rested (i.e., straight and not bent) position when the panel members are stacked. It will further be appreciated that the hinge member 70 can be employed with the panel member 51 of FIG. 5, wherein there are no separate surface types 44 and 47 as in FIG. 2, but rather with solid continuous surfaces 52 and 53 as shown in FIG. 5.

The hinge member of the present invention can be formed of ABS material, with the living hinge element formed of urethane, ABS, PVC or other flexible material, whereby the living hinge element is co-extruded with the ABS tabs (e.g., connector members 65) of the remainder of the hinge member (e.g., 70) in order to provide the stable yet flexible properties necessary for the invention to work as described herein. Co-extrusion is the simultaneous extrusion of two or more thermoplastic resins into a sandwich like film, usually with clearly distinguishable layers. In one embodiment of the present invention, the hinge member is solvent welded together and the living hinge element, while not stretching to any great degree, remains flexible in an accordion-type fashion. In another embodiment of the present invention, panel members of a certain size can be custom formed to nearly any dimension with hinge members 70 solvent welded or otherwise permanently attached so as to connect all individual panel members in a pre-formed flooring of desired dimension. Thus, for example, if a particular application requires a flooring of sixteen feet by eighty feet, and if panel members are employed having a dimension of approximately eight inches wide by five feet long, then twenty-four panels can be attached side by side to give the proper width (i.e., twenty-four times eight inches equals 192 inches, or sixteen feet) for one row. By providing sixteen such rows (i.e., sixteen times five feet wide), the desired eighty foot width is covered. The seams between each row can be secured by hook and loop fashion as described above, for example.

It will be appreciated that the assembly of connected panel members in any given implementation can employ different types of hinge members described herein. For example, connector members 65 from FIG. 6A can be used to connect a series of panels up to a given stackable size desired, then a hinge member 70 can be employed at the end of that set, followed by another set of panels connected by connector members 65. In this way, there is no flexible rotation of each panel to the next, but only after a certain series of panels. In the example stated above, the twenty-four side by side panels can be connected using three hinge members 70 and twenty connector members 65. From the first panel on the edge of the flooring, there would be a connector member 65 and another panel and additional connector members 65 and panel members would be connected similarly until six panels were connected. The sixth panel would be connected to the seventh panel using hinge member 70, then five additional panels would be connected using connector members 65. The process would repeat itself until the twenty-four panels were connected. In such fashion, the flooring can be stacked up such that there is a flexible hinge connection after every six panels, whereby the twenty-four panels can easily be stacked four sets high (with each set containing six panels). This flexibility in hinge member arrangements facilitates quick installation and stack up of flooring for easy transport, storage and use.

In another embodiment of the invention, the present invention can be assembled and deployed as follows. First, a plurality of panels or slats are obtained and either slidingly engaged or snappingly engaged edge to edge with a hinge member. Next, an adjoining row of similarly assembled panels can be aligned end-to-end with the first series of panels, and secured together using a wider "hook" strip on the bottom side of the panels as described above. Alternatively, a hook and loop arrangement can be provided along the top sides of the panels, with a cap member top hiding any otherwise exposed crease or opening. The adjacent rows of panels can create a large flooring cover. The system of the present invention can allow a rectangular flooring to be constructed by aligning multiple panel or slat members edge to edge in parallel rows. While described in terms of a rectangular shape, it will be apparent from the disclosure herein that the present invention can be adapted to suit other shapes as desired, including without limitation, circular, polygonal or other shape. When it is desired to remove and/or transport the flooring, the hook-and-loop type fastener can be removed, and the flooring slats can be folded upon one another so as to stack in a neat, compact manner.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed and desired to be secured by Letters Patent is:

1. A flooring, comprising:

a first and second slat, each slat having a length, substantially parallel upper and lower wall surfaces, and first and second side walls, with a substantially C-shaped female member integrally formed with at least one side wall of each of the first and second slats; and a living hinge element for allowing the slats to be folded onto one another in close fitting engagement such that the respective upper wall surfaces can touch each other while residing in substantially parallel relation to each other while retaining connection of the side walls, wherein the living hinge element has two male end tips, with each male end tip secured to a respective connector member, wherein each connector member is a substantially H-shaped member having two side wall members connected by a middle connector member.

2. The flooring of claim 1 wherein the two side wall members of each connector member are substantially parallel and are connected at substantially the midpoint thereof by the respective middle connector member.

3. The flooring of claim 1 wherein the living hinge element is secured at one male end tip to a first connector member side wall, and secured at the other male end tip to a second connector member side wall.

4. The flooring of claim 1 wherein the first and second connector members include at least one side wall having a vertical edge, and wherein the living hinge element is secured at one male end tip to the vertical edge of the first connector member side wall, and secured at the other male end tip to the vertical edge of the second connector member side wall.

5. A method of providing a fold-up surface, comprising the steps of:

providing a first and second slat, each slat having a length, substantially parallel upper and lower walls, and first and second side walls;

providing the first side wall and second side wall of each slat with hinge engaging edge members;

providing an attachment member for attaching the first and second slats, the attachment member having a living hinge element with two male end tips, with a first male end tip secured to a first connector member and a second male end tip secured to a second connector member, wherein each of the first and second connector members is a substantially H-shaped member having two side wall members connected by a middle connector member, and where the first connector member cooperatively engages a side wall hinge engaging edge member of the first slat and the second connector member cooperatively engages a side wall hinge engaging edge member of the second slat, so as to permit relative rotation of each of the first and second slats about an axis parallel to the side walls such that the respective upper wall surfaces can touch each other.

6. The method of claim 5, wherein each slat first side wall hinge engaging edge member comprises a substantially C-shaped member having top and bottom substantially hook-shaped portions having respective outward face portions that are substantially coplanar.

7. The method of claim 6 wherein the top hook-shaped portion extends outwardly from, and substantially coplanar with, the upper wall, and wherein the bottom hook-shaped portion extends from a curved bottom edge of the bottom wall so as not to have a portion that is coplanar with the bottom wall.

8. The method of claim 5, wherein each slat first side wall hinge engaging edge member comprises a substantially C-shaped member having top and bottom portions connected by a connector portion, wherein the connector portion is integrally formed with the slat first side wall.

9. The method of claim 8, wherein each slat second side wall hinge engaging edge member comprises a substantially C-shaped member having top and bottom portions connected by a connector portion, wherein the connector portion is integrally formed with the slat first side wall.

10. The method of claim 5, wherein the slat members are provided such that the top portion of each slat member is not a mirror image of the bottom portion thereof.

11. The method of claim 5, wherein the side wall hinge engaging edge members are provided such that the top portion of each hinge engaging edge member is not a mirror image of the bottom portion thereof.

12. The method of claim 5, wherein the slats are provided such that the upper and lower walls comprise substantially planar surfaces.

13. The method of claim 5, wherein the two side wall members of each of the first and second connector members are substantially parallel and are connected at substantially the midpoint thereof by the respective middle connector member.

* * * * *